US009406494B2

(12) United States Patent
Brown et al.

(10) Patent No.: US 9,406,494 B2
(45) Date of Patent: Aug. 2, 2016

(54) SPATIALLY CORRELATED DYNAMIC FOCUSING

(71) Applicant: Micromass UK Limited, Wilmslow (GB)

(72) Inventors: Jeffery Mark Brown, Hyde (GB); Martin Raymond Green, Bowdon (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 14/772,439

(22) PCT Filed: Mar. 5, 2014

(86) PCT No.: PCT/GB2014/050638
§ 371 (c)(1),
(2) Date: Sep. 3, 2015

(87) PCT Pub. No.: WO2014/135862
PCT Pub. Date: Sep. 12, 2014

(65) Prior Publication Data

US 2016/0013039 A1 Jan. 14, 2016

(30) Foreign Application Priority Data

Mar. 5, 2013 (EP) ..... 13157768
Mar. 5, 2013 (GB) ..... 1303919.3

(51) Int. Cl.
*H01J 49/00* (2006.01)
*H01J 49/40* (2006.01)

(52) U.S. Cl.
CPC ..... *H01J 49/401* (2013.01); *H01J 49/0031* (2013.01); *H01J 49/403* (2013.01)

(58) Field of Classification Search
None
See application file for complete search history.

(56) References Cited

U.S. PATENT DOCUMENTS

| | | | | | |
|---|---|---|---|---|---|
| 4,707,602 | A * | 11/1987 | Knorr | G01N 27/622 | 250/281 |
| 2002/0100870 | A1* | 8/2002 | Whitehouse | B82Y 30/00 | 250/281 |
| 2004/0004773 | A1* | 1/2004 | Khursheed | H01J 37/285 | 359/800 |
| 2010/0252728 | A1* | 10/2010 | Mackie | H01J 49/403 | 250/282 |
| 2012/0138788 | A1* | 6/2012 | Taniguchi | H01J 49/004 | 250/287 |

FOREIGN PATENT DOCUMENTS

| | | | | |
|---|---|---|---|---|
| CA | WO 2011138669 | A2 * | 11/2011 | H01J 49/0095 |
| CA | WO 2011138669 | A3 * | 12/2011 | H01J 49/0095 |
| DE | GB 2299446 | A * | 10/1996 | H01J 49/401 |
| GB | 2299446 | | 10/1996 | |
| GB | WO 2011107738 | A1 * | 9/2011 | H01J 49/34 |
| GB | 2486820 | | 6/2012 | |
| GB | 2486820 | A * | 6/2012 | H01J 49/0031 |
| GB | 2486820 | B * | 8/2013 | H01J 49/0031 |
| WO | 83/00258 | | 1/1983 | |
| WO | 2011/107738 | | 9/2011 | |
| WO | 2011/138669 | | 11/2011 | |

OTHER PUBLICATIONS

Wiley et al., "*Time-of-Flight Mass Spectrometer with Improved Resolution*", Review of Scientific Instruments, vol. 26, pp. 1150, 1955.

* cited by examiner

*Primary Examiner* — Andrew Smyth
(74) *Attorney, Agent, or Firm* — Diederiks & Whitelaw, PLC

(57) ABSTRACT

A Time of Flight mass analyzer is disclosed comprising one or more acceleration electrodes and a first device arranged and adapted to apply a DC voltage pulse to the one or more acceleration electrodes. The DC voltage pulse causes ions to be accelerated into a time of flight or drift region and the DC voltage pulse is applied, in use, to the one or more acceleration electrodes between a time $T_1$ and a time $T_2$. A second device is arranged and adapted to apply a single phase oscillating voltage to the one or more acceleration electrodes, wherein the single phase oscillating voltage undergoes multiple oscillations between the time $T_1$ and the time $T_2$. The application of the DC voltage pulse and the single phase oscillating voltage to the one or more acceleration electrodes establishes an homogeneous electric field having a net force towards the time of flight or drift region.

12 Claims, 3 Drawing Sheets

$$T/dT = \frac{ToFRef(m,0)}{25300} \sqrt{dT_rough1REF(m)^2 + dT_rough2REF(m)^2}$$

SPATIALLY CORRELATED DYNAMIC FOCUSING

CROSS-REFERENCE TO RELATED APPLICATION

This application is the National Stage of International Application No. PCT/GB2014/050638, filed 5 Mar. 2014 which claims priority from and the benefit of United Kingdom patent application No. 1303919.3 filed on 5 Mar. 2013 and European patent application No. 13517768.6 filed 5 Mar. 2013. The entire contents of these applications are incorporated herein by reference.

BACKGROUND OF THE PRESENT INVENTION

The present invention relates to a Time of Flight mass analyser, a mass spectrometer, a method of analysing ions and a method of mass spectrometry. The preferred embodiment relates to an orthogonal acceleration Time of Flight mass analyser.

It is known to apply a DC voltage pulse to a pusher electrode located in an orthogonal acceleration region of a Time of Flight mass analyser. The DC voltage pulse which is applied to the pusher electrode generates a DC electric field which causes ions to be orthogonally accelerated from the orthogonal acceleration region into the drift region of the Time of Flight mass analyser.

Wiley and McLaren (Time-of-Flight Mass Spectrometer with Improved Resolution, (Review of Scientific Instruments 26, 1150 (1955), W C Wiley, I H McLaren) set out the basic equations that describe two stage extraction Time of Flight mass spectrometers. The principles apply equally to continuous axial extraction Time of Flight mass analysers and orthogonal acceleration Time of Flight mass analysers and time lag focussing instruments.

In a Time of Flight mass analyser it is preferable to optimise the geometry and amplitude of the electric fields so that the deviation in arrival times as measured at the detector, for ions of the same mass to charge ratio, is only a small function of the initial ion spatial coordinates.

Consider ions in the pusher field of an orthogonal acceleration Time of Flight mass analyser having a coordinate x (with no initial velocity component). The time of flight can be expanded spatially as follows as a function of x:

$$\mathrm{ToF}(x)=A+B\cdot x+C\cdot x^2+D\cdot x^3 \quad (1)$$

For a system spatially focused to first order, the coefficient B is arranged to be zero. This is achieved by choosing the appropriate amplitude and lengths of the electric fields and field free regions. For a system to be second order focused, the coefficients B and C are arranged to be zero. For a system to third order focused, the coefficients B, C and D are arranged to be zero and so on.

Most commercial systems are first and second order spatially focused and the spatial time of flight aberration is usually very small so as not to affect the overall resolving power of the system. However, available geometries required to achieve second and higher order focusing can be limited and can cause compromises in other areas of performance.

Another significant aberration on Time of Flight systems is known as the "turn around time". This is caused by the initial velocity spread of ions prior to extraction with the pusher field. Consider two ions with the same initial kinetic energy but with equal and opposite velocity components. When the pusher field is applied, the ion with the negative velocity has to be turned around before it can set off in the time of flight direction. This turn around time limits the resolving power of commercial Time of Flight mass analyser systems.

The value of the aberration is 2·u/a wherein u is the initial velocity component and a is the acceleration of the pusher field.

The ions will be separated by a turnaround time Δt which is smaller for steeper acceleration fields. This is often the major limiting aberration in Time of Flight instrument design and instrument designers go to great lengths to minimise this term.

The most common approach to minimising this aberration is to accelerate the ions as forcefully as possible i.e. the acceleration term a is made as large as possible by maximising the electric field i.e. the ratio Vp/Lp. This is normally achieved by making the pusher voltage Vp large and the acceleration stage length Lp short. However, this approach has a practical limit for a two stage geometry as the Wiley McLaren type spatial focussing solution leads to shorter physical instruments which will have very short flight times. Very short flight times would require ultra fast high bandwidth detection systems and hence are impracticable.

A known solution to this problem is to add a reflectron wherein the first position of spatial focus is re-imaged at the ion detector. This leads to longer practical flight time instruments which are capable of relatively high resolution.

In conventional reflectron Time of Flight instruments the reflectron may comprise either a single stage reflectron or a two stage reflectron whilst in both reflectron and non-reflectron Time of Flight instruments the extraction region usually comprises a two stage Wiley/McLaren source. Usually within these geometries the objective is to achieve perfect first or second order space focusing or to re-introduce a small first order term to further improve space focusing.

It is known that a small first order term may be arranged to compensate for linear pre-extraction velocity-position correlations obtained in various ion transfer configurations.

Despite known approaches to space focusing, the practical performance of known Time of Flight instruments is limited by space focusing characteristics. These limitations are most evident in the relationship between resolution and sensitivity.

US 2002/100870 (Whitehouse) discloses a Time of Flight mass spectrometer with a pulsing region as shown in FIG. 1A. A pseudo potential well is created in the time of flight region by the combination of a pseudo potential barrier formed near the surface 12 of a pusher electrode 11 and a static electric field formed in the time of flight pulsing region by a potential difference applied between the pusher electrode 11 and a counter or extraction electrode 13 (grid electrode). The surface 12 of the pusher electrode 11 comprises an array of electrodes such as a square array of wire tips with neighbouring wire tips alternately connected to opposite phases of a high frequency alternating voltage. An inhomogeneous field is generated creating a pseudo-potential barrier which penetrates a short distance above the pusher electrode 11.

GB 2299446 (Franzen) discloses a multipole rod arrangement as shown in FIG. 3 which is used to orthogonally inject ions into a Time of Flight mass spectrometer.

US 2012/0138788 (Taniguchi) discloses an arrangement as shown in FIG. 1 wherein a plurality of ions are ejected from an ion trap into a Time of Flight mass spectrometer 4.

WO 2011/107738 (Bream) discloses a mass spectrometer as shown in FIG. 4 wherein a transient voltage is applied to an electrode 40 in order to accelerate ions having different masses to approximately equal velocities. The ions are then differentiated at an ion detector by their kinetic energies.

US 2010/0252728 (Mackie) discloses a mass spectrogram employing a set of controllable electrodes to produce a time varying axially inhomogeneous electric field as shown in FIG. 2.

WO 83/00258 (Muga) discloses an arrangement as shown in FIG. 1 wherein ions experience a monotonically time-varying acceleration field.

GB-2486820 (Micromass) discloses a fast pushing time of flight mass spectrometer.

WO 1011/138669 (Albeanu) discloses a triple switch topology for delivering ultrafast pulser polarity switching.

U.S. Pat. No. 4,707,602 (Knorr) discloses a Fourier Transform time of flight mass spectrometer.

It is desired to provide an improved Time of Flight mass analyser.

SUMMARY OF THE PRESENT INVENTION

According to an aspect of the present invention there is provided a Time of Flight mass analyser comprising:

one or more acceleration electrodes; and a first device arranged and adapted to apply a DC voltage pulse to the one or more acceleration electrodes, wherein the DC voltage pulse causes ions to be accelerated into a time of flight or drift region and wherein the DC voltage pulse is applied, in use, to the one or more acceleration electrodes between a time $T_1$ and a time $T_2$;

wherein the Time of Flight mass analyser further comprises:

a second device arranged and adapted to apply a single phase oscillating voltage to the one or more acceleration electrodes, wherein the single phase oscillating voltage undergoes multiple oscillations between the time $T_1$ and the time $T_2$ and wherein the application of the DC voltage pulse and the single phase oscillating voltage to the one or more acceleration electrodes establishes a substantially homogeneous electric field having a net force towards the time of flight or drift region.

The application of the single phase oscillating voltage to the one or more acceleration electrodes preferably does not create a pseudo-potential barrier in the vicinity of the one or more acceleration electrodes.

The homogenous electric field which is preferably established is preferably spatially homogenous.

According to the present invention a single phase oscillating voltage is applied to the one or more acceleration electrodes. The single phase oscillating voltage undergoes multiple oscillations between the time $T_1$ and the time $T_2$ and the application of the single phase oscillating voltage to the one or more acceleration electrodes creates a homogenous electric field. In contrast, the arrangement disclosed in US 2002/0100870 (Whitehouse) creates an inhomogeneous electric field so that a pseudo-potential barrier is created in the vicinity of the acceleration electrode in order to confine ions. In contrast, the present invention does not create a pseudo-potential barrier in the vicinity of the one or more acceleration electrodes in order to confine ions.

Furthermore, according to the present invention the application of the single phase oscillating voltage creates a net force which is preferably always towards the time of flight or drift region and the ion detector. The net electric field does not cause ions to oscillate and does not cause the ions to move in a direction away from the time of flight or drift region. Instead, the net electric field preferably merely changes in amplitude but not polarity. This is in contrast to the arrangement disclosed in US 2002/0100870 (Whitehouse) wherein a pseudo-potential barrier is created in the vicinity of the acceleration electrodes and ions experience a force in a direction away from the time of flight or drift region.

In contrast to the arrangement disclosed in WO 83/00258 (Muga), according to the present invention a minor corrective field is preferably applied to the acceleration electrode(s) that allows the control and optimisation of the second order spatial focusing term. The main first order spatial focusing component is provided in a conventional manner and a high field pusher voltage can be retained. Furthermore, an expanded beam can also be retained in the orthogonal acceleration region.

Advantageously, the second order spatial focusing of ions having a range of different mass to charge ratios can be simultaneously corrected in the same orthogonal acceleration time of flight pulse.

According to the preferred embodiment a time varying oscillating field with multiple oscillations during the same orthogonal acceleration time of flight pulse is preferably provided. This is in contrast to the arrangement disclosed in WO 83/00258 (Muga).

The method of correcting for second order spatial focusing according to the preferred embodiment can be implemented for ions that are approaching the first order spatial focus.

According to an embodiment an ion trap or ion storage device may be provided upstream of the Time of Flight mass analyser and may be arranged to release packets or pulses of ions having mass to charge ratios which are optimised for the second order spatial focusing enhancement which is preferably performed by the Time of Flight mass analyser.

According to an aspect of the present invention there is provided a Time of Flight mass analyser comprising:

one or more acceleration electrodes; and a device arranged and adapted to apply a time varying, oscillating or AC voltage to the one or more acceleration electrodes, wherein the time varying, oscillating or AC voltage comprises a voltage waveform having a sinusoidal, sawtooth or triangular waveform;

a device arranged and adapted to apply a DC voltage pulse to the one or more acceleration electrodes, wherein the DC voltage pulse causes ions to be accelerated into a time of flight or drift region and wherein the device is arranged and adapted to apply the DC voltage pulse to the one or more acceleration electrodes at substantially the same time as the device applies the time varying or AC voltage to the one or more acceleration electrodes; and wherein the time varying or AC voltage preferably causes ions to experience an electric field that provides a spatially correlated energy deviation so as to reduce second or higher order spatial focussing aberrations.

According to an aspect of the present invention there is provided a Time of Flight mass analyser comprising:

one or more acceleration electrodes; and a device arranged and adapted to apply a time varying or AC voltage to the one or more acceleration electrodes, wherein the time varying or AC voltage comprises a voltage waveform having a sinusoidal, sawtooth or triangular waveform.

The present invention relates to the time varying control of an electric field within a Time of Flight mass spectrometer in order to reduce the spatial focusing aberrations for a specific mass to charge ratio range or multiple groups of targeted mass to charge ratio values.

A Time of Flight mass spectrometer is disclosed including a dynamic electric field that varies during the time of flight of ions within the electric field. The time varying or AC electric field causes ions having particular mass to charge ratios to attain energy deviations which depend on their initial spatial positions. Specific and/or multiple mass to charge ratio regions of interest are preferably arranged to arrive at the Time of Flight ion detector with reduced spatial focusing aberrations thereby increasing the resolving power of the Time of Flight mass analyser.

According to an aspect of the present invention there is provided a Time of Flight mass analyser comprising:

one or more acceleration electrodes; and a (first) device arranged and adapted to apply a time varying or AC voltage to the one or more acceleration electrodes.

The Time of Flight mass analyser preferably further comprises a (second) device arranged and adapted to apply a DC voltage pulse to the one or more acceleration electrodes.

The DC voltage pulse preferably causes ions to be accelerated into a time of flight or drift region.

The device is preferably arranged and adapted to apply the DC voltage pulse to the one or more acceleration electrodes at substantially the same time as the device applies the time varying or AC voltage to the one or more acceleration electrodes.

The time varying or AC voltage is preferably arranged and adapted to correct and/or control and/or reduce second or higher order spatial focussing aberrations.

The time varying or AC voltage preferably comprises a voltage waveform having a sinusoidal, triangular or sawtooth waveform.

The Time of Flight mass analyser preferably comprises an orthogonal acceleration Time of Flight mass analyser.

The one or more acceleration electrodes preferably comprise one or more orthogonal acceleration electrodes for orthogonally accelerating ions into a time of flight or drift region.

The single phase oscillating voltage preferably has a frequency selected from the group consisting of: (i) <100 kHz; (ii) 100-500 kHz; (iii) 500-1000 kHz; (iv) 1-5 MHz; (v) 5-10 MHz; (vi) 10-50 MHz; (vii) 50-100 MHz; (viii) 100-500 MHz; (ix) 500-1000 MHz; (x) 1-5 GHz; (xi) 5-10 GHz; and (xii) >10 GHz.

According to an aspect of the present invention there is provided a mass spectrometer comprising a Time of Flight mass analyser as described above.

According to an aspect of the present invention there is provided a method of analysing ions comprising:

providing one or more acceleration electrodes; and applying a DC voltage pulse to the one or more acceleration electrodes between a time $T_1$ and a time $T_2$ so as to cause ions to be accelerated into a time of flight or drift region;

wherein the method further comprises:

applying a single phase oscillating voltage to the one or more acceleration electrodes, wherein the single phase oscillating voltage undergoes multiple oscillations between the time $T_1$ and the time $T_2$ and wherein the application of the DC voltage pulse and the single phase oscillating voltage to the one or more acceleration electrodes establishes a substantially homogeneous electric field having a net force towards the time or flight or drift region.

According to another aspect of the present invention there is provided a method of mass spectrometry comprising a method as described above.

According to an aspect of the present invention there is provided a method of analysing ions comprising:

applying a time varying or AC voltage to one or more acceleration electrodes of a Time of Flight mass analyser.

According to an aspect of the present invention there is provided an orthogonal acceleration Time of Flight mass analyser comprising:

one or more orthogonal acceleration electrodes;

a device arranged and adapted to apply a DC voltage to the one or more orthogonal acceleration electrodes in order to orthogonally accelerate at least some ions into a time of flight or drift region of the mass analyser; and a device arranged and adapted to apply a time varying or AC voltage to the one or more orthogonal acceleration electrodes at substantially the same time as the DC voltage in order to reduce second order spatial focussing aberrations.

According to an aspect of the present invention there is provided a method of mass analysing ions comprising:

applying a DC voltage to one or more orthogonal acceleration electrodes in order to orthogonally accelerate at least some ions into a time of flight or drift region of an orthogonal acceleration Time of Flight mass analyser; and applying a time varying or AC voltage to the one or more orthogonal acceleration electrodes at substantially the same time as applying the DC voltage in order to reduce second order spatial focussing aberrations.

According to an aspect of the present invention there is provided a Time of Flight mass analyser comprising:

one or more orthogonal acceleration electrodes;

a drift or time of flight region arranged downstream of the one or more orthogonal acceleration electrodes;

one or more electrodes arranged in the drift or time of flight region; and a device arranged and adapted to apply an oscillating voltage to the one or more electrodes arranged in the drift or time of flight region in order to reduce second or higher order spatial focusing aberrations.

According to an aspect of the present invention there is provided a method of analysing ions comprising:

providing one or more orthogonal acceleration electrodes, a drift or time of flight region arranged downstream of the one or more orthogonal acceleration electrodes and one or more electrodes arranged in the drift or time of flight region; and applying an oscillating voltage to the one or more electrodes arranged in the drift or time of flight region in order to reduce second or higher order spatial focusing aberrations.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; and (xxvi) a Solvent Assisted Inlet Ionisation ("SAII") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide is preferably maintained at a pressure selected from the group consisting of: (i) <0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar.

BRIEF DESCRIPTION OF THE DRAWINGS

Various embodiments of the present invention will now be described, by way of example only, and with reference to the accompanying drawings in which.

DETAILED DESCRIPTION OF PREFERRED EMBODIMENTS

A preferred embodiment of the present invention will now be described.

It is the aim of the preferred embodiment of the present invention to correct and control second order spatial focusing aberrations in a Time of Flight mass analyser. Spatial focusing aberrations are normally corrected for by using multiple stage DC fields either within a reflectron stage or within an initial two-stage acceleration region of the Time of Flight mass analyser.

According to a preferred embodiment of the present invention a supplemental time varying, oscillating or AC electric field is also maintained in the pusher region and is preferably used to provide second or higher order spatial focusing corrections.

Conventionally, normally (just) a DC or constant electric field is established in the pusher region of an orthogonal acceleration Time of Flight mass analyser by applying a DC voltage to a pusher electrode.

Figure 1:
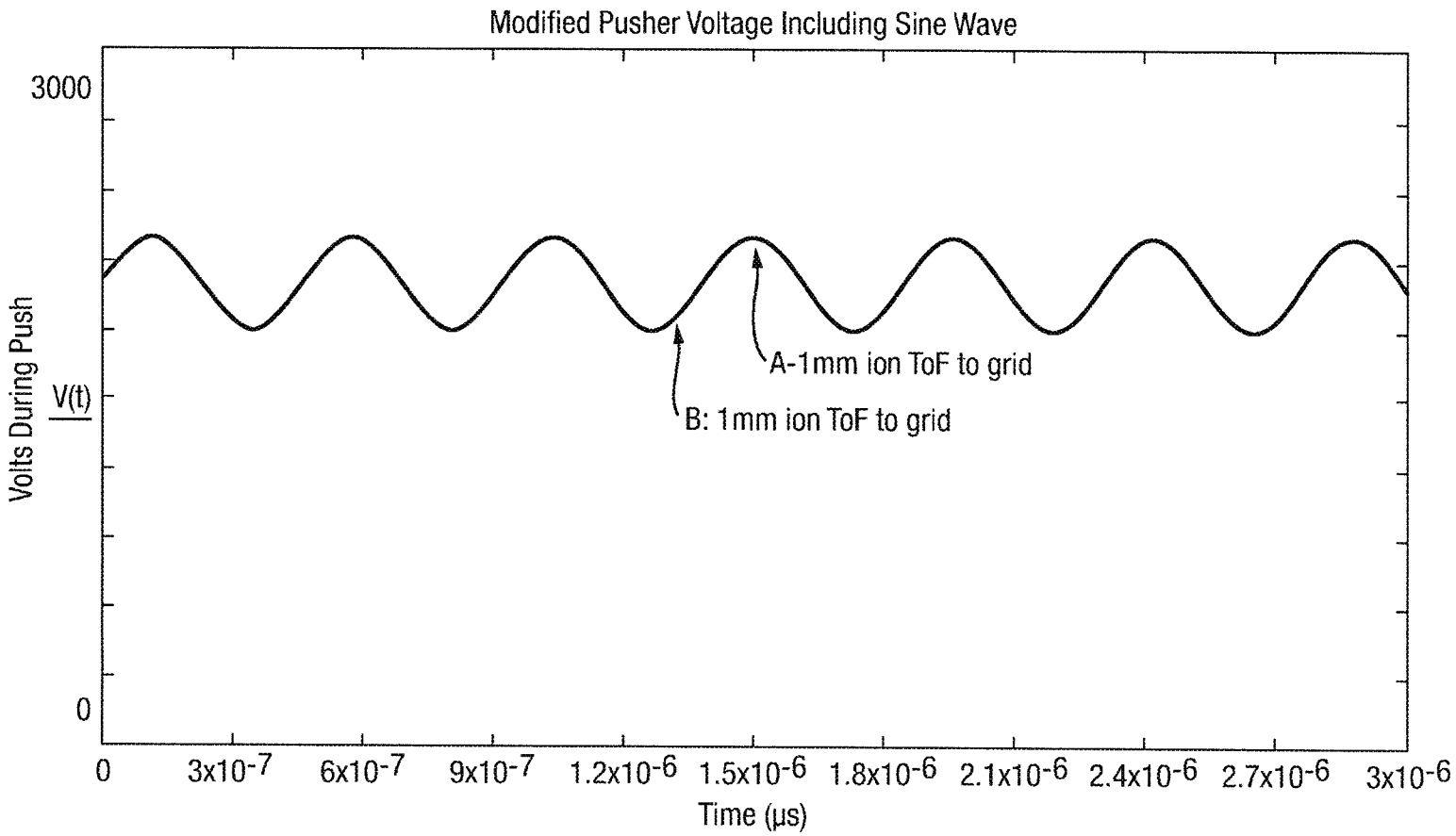
FIG. 1 shows a supplemental time varying or oscillating voltage which is additionally applied to a pusher electrode of an orthogonal acceleration Time of Flight mass analyser in accordance with an embodiment of the present invention.

According to a preferred embodiment of the present invention a supplemental time varying, oscillating or AC voltage (e.g. a voltage having a sine wave waveform as shown in FIG. 1) is additionally applied to the pusher electrode in order to establish an additional spatial focusing correction which is not obtained by applying just a conventional fixed or DC voltage pulse to a pusher or orthogonal acceleration electrode.

The effect on the space focusing characteristics of additionally applying a time varying, oscillating or AC electric field may be illustrated as follows. If one particular mass to charge ratio is considered, then the ions located closest (+1 mm) to the pusher exit grid electrode when the DC and AC or oscillating pusher voltages are applied to the pusher or orthogonal acceleration electrode will arrive at the pusher exit grid electrode at a time B. Ions located farthest (−1 mm) from the pusher exit grid electrode will arrive at a subsequent time A. Ions located between the two extremes will arrive at the pusher exit grid electrode at a time after time B and before time A. These ions will experience an electric field that is changing and which is designed to provide a spatially correlated energy deviation that is tailored to improve spatial focusing, especially second or higher order spatial focusing.

Although the preferred embodiment only enhances the resolving power at one or several mass to charge ratio regions, this is nonetheless of significant benefit in targeted analysis applications where higher performance is required over one or several specific mass to charge ratio regions.

Figure 2:
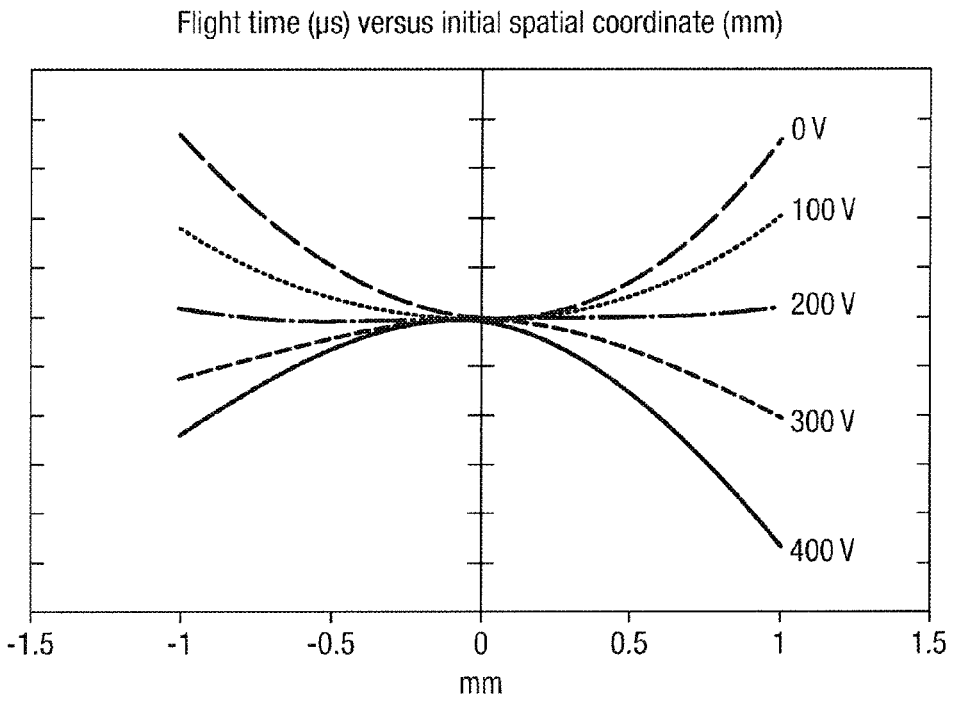
FIG. 2 shows the flight time of ions as a function of their initial starting position for different amplitude supplemental time varying voltages.

FIG. 2 shows the calculated time of flight of ions as a function of their initial starting position at the first space focus point in relation to a simple single acceleration stage Time of Flight mass analyser. With no sine wave applied (i.e. at 0 V) which corresponds with a conventional pusher electrode arrangement it is apparent that the predominant spatial aberration term is second order. However, when an additional 200 V sine wave voltage is applied to the pusher electrode then in accordance with the preferred embodiment of the present invention for this specific mass to charge ratio the second order spatial focusing term is reduced substantially. It can be seen that by varying the amplitude of the additional sine wave or AC voltage which is preferably additionally applied to the pusher electrode that the second order spatial focus term can be substantially tuned out.

The ability to independently correct for space focus aberrations in this way enables a wider range of Time of Flight geometries to be used in the design of a Time of Flight mass analyser due to an extra degree of freedom which is afforded by the present invention.

It is apparent, therefore, that the present invention is particularly advantageous.

Commercial high resolution orthogonal acceleration Time of Flight mass analysers become limited in time of flight resolution at low mass to charge ratios with faster flight times. In order to enhance time of flight resolution for low masses, it would be advantageous to reduce the overall time of flight acceleration voltages in order to increase the time of flight and address inaccuracies associated with timing and digitisation. However, simply reducing all the voltages in the system would retain good spatial focusing and increase the flight time, but the bi-directional velocity spread or "turn-around" aberration would then dominate. Therefore, it is advantageous to retain a high field pusher field (to keep the turn-around time low) but to also reduce the flight tube voltage or even decelerate ions after acceleration.

However, calculations indicate that with a conventional high field DC pusher and low ion energies in the flight tube then the second order space focus aberrations will significantly limit resolution. By applying a space correlated dynamic field in accordance with the preferred embodiment the second order term can be significantly reduced enabling substantially higher resolving powers at low mass to charge ratios within the same fixed ion optical geometry.

It is apparent, therefore, that the present invention is particularly advantageous and represents a significant improvement in the art.

Another example of the utility of the present invention is a Time of Flight mass analyser that utilises phase space focusing optics which are designed to reduce the turn-around time by expanding the ion beam spatially in the pusher region and advantageously reducing the initial velocity spread. Larger spatial beams require better spatial focusing design and the limitations imposed by fixed geometry optical components may be alleviated by the above described approach in accordance with an embodiment of the present invention.

Figure 3:
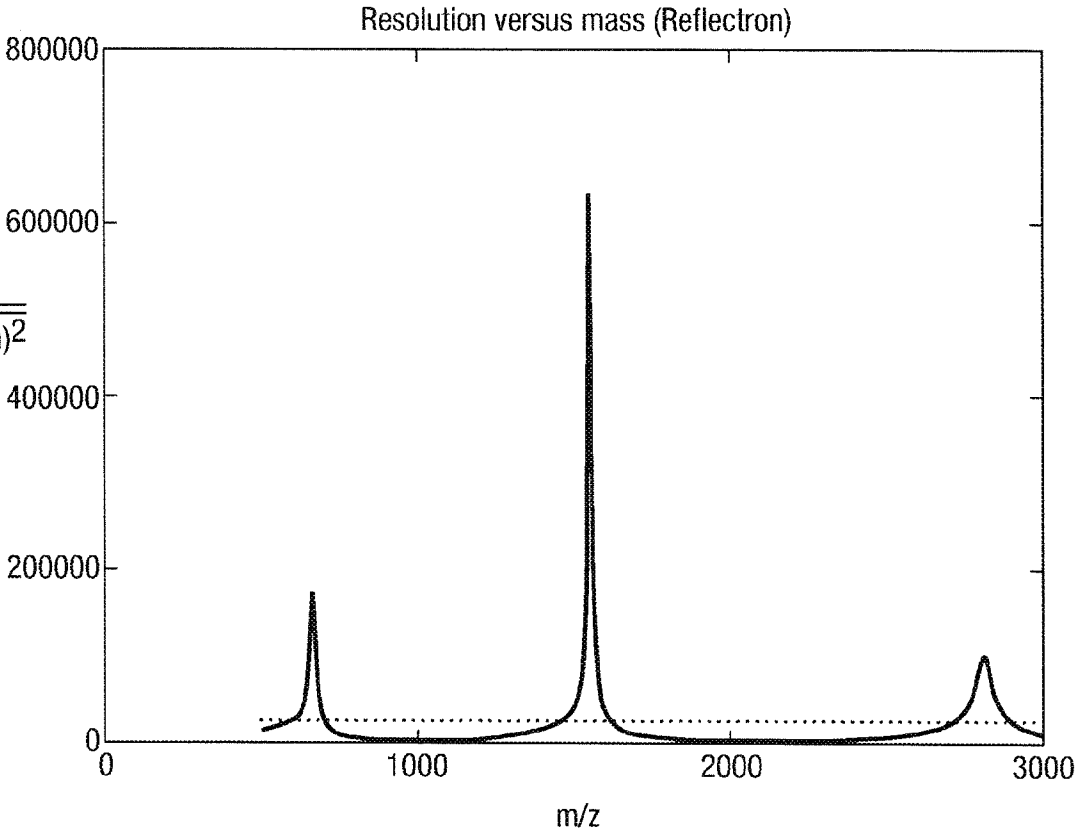
FIG. 3 shows how the resolution for ions having a particular mass to charge ratio is significantly improved according to an embodiment of the present invention.

FIG. 3 illustrates a zoomed mass to charge ratio region of enhanced resolution as a function of mass to charge ratio for a 40 cm single stage reflectron system, (T/dT at base i.e. approximately M/dM) and shows that according to the preferred embodiment a resolution in excess of 600,000 FWHM may be achieved. These approximations do not include the turn-around time or third and higher order spatial aberrations but they do, nonetheless, illustrate the significant and very substantial improvements in resolution which may be obtained by utilising the present invention.

The dashed line at around 25,000 T/dT indicates the space focus limited resolving power for a conventional mass spectrometer utilising a fixed DC electric field extraction.

It is apparent that the present invention enables a substantial and significant improvement in resolution to be achieved for ions having a particular mass to charge ratio.

The preferred embodiment is primarily aimed at reducing second order spatial focusing aberrations via an additional degree of freedom. However, other embodiments are also contemplated wherein higher order spatial focusing terms may also be controlled in a similar manner using different electric field functions.

Applying a supplemental time varying or AC electric field in the manner as described above but in a region closer to the first space focus has the advantage that the spatial dispersion (caused by the initial starting positions) relative to the spatial dispersion (caused by a fixed Δ mass to charge ratio) can be arranged to allow many more regions of enhanced focusing from a periodic supplemental field, thereby allowing ions of adjacent isotopes and mass deficiencies to be better focused whilst potentially sacrificing ions that occur in between the mass sufficiency regions.

Staggered or scanned application of different supplemental time dependent or AC electric fields in order to generate fully resolved spectra over a wider or full mass to charge ratio ranges (sacrificing the less resolved data in each scan) is also contemplated.

Although the present invention has been described with reference to preferred embodiments, it will be understood by those skilled in the art that various changes in form and detail may be made without departing from the scope of the invention as set forth in the accompanying claims.

The invention claimed is:

1. A Time of Flight mass analyser comprising:

one or more acceleration electrodes; and a first device arranged and adapted to apply a DC voltage pulse to said one or more acceleration electrodes, wherein said DC voltage pulse causes ions to be accelerated into a time of flight or drift region and wherein said DC voltage pulse is applied, in use, to said one or more acceleration electrodes between a time $T_1$ and a time $T_2$;

wherein said Time of Flight mass analyser further comprises:

a second device arranged and adapted to apply a single phase oscillating voltage to said one or more acceleration electrodes, wherein said single phase oscillating voltage undergoes multiple oscillations between said time $T_1$ and said time $T_2$; and wherein the application of said DC voltage pulse and said single phase oscillating voltage to said one or more acceleration electrodes establishes a substantially homogeneous electric field having a net force towards said time of flight or drift region.

2. A Time of Flight mass analyser as claimed in claim 1, wherein said oscillating voltage comprises a sinusoidal, sawtooth or triangular waveform.

3. A Time of Flight mass analyser as claimed in claim 1, wherein said first device is arranged and adapted to apply said DC voltage pulse to said one or more acceleration electrodes at substantially the same time as said second device applies said oscillating voltage to said one or more acceleration electrodes.

4. A Time of Flight mass analyser as claimed in claim 1, wherein said oscillating voltage causes ions to experience an electric field that provides a spatially correlated energy deviation so as to reduce second or higher order spatial focusing aberrations.

5. A Time of Flight mass analyser as claimed in claim 1, wherein said Time of Flight mass analyser comprises an orthogonal acceleration Time of Flight mass analyser.

6. A Time of Flight mass analyser as claimed in claim 1, wherein said one or more acceleration electrodes comprise one or more orthogonal acceleration electrodes for orthogonally accelerating ions into a time of flight or drift region.

7. A Time of Flight mass analyser as claimed in claim 1, wherein said single phase oscillating voltage has a frequency selected from the group consisting of: (i) <100 kHz; (ii) 100-500 kHz; (iii) 500-1000 kHz; (iv) 1-5 MHz; (v) 5-10 MHz; (vi) 10-50 MHz; (vii) 50-100 MHz; (viii) 100-500 MHz; (ix) 500-1000 MHz; (x) 1-5 GHz; (xi) 5-10 GHz; and (xii) >10 GHz.

8. A mass spectrometer comprising a Time of Flight mass analyser as claimed in claim 1.

9. A method of analysing ions comprising:

providing one or more acceleration electrodes; and applying a DC voltage pulse to said one or more acceleration electrodes between a time $T_1$ and a time $T_2$ so as to cause ions to be accelerated into a time of flight or drift region;

wherein said method further comprises:

applying a single phase oscillating voltage to said one or more acceleration electrodes, wherein said single phase oscillating voltage undergoes multiple oscillations between said time $T_1$ and said time $T_2$ and wherein the application of said DC voltage pulse and said single phase oscillating voltage to said one or more acceleration electrodes establishes a substantially homogeneous electric field having a net force towards said time of flight or drift region.

10. A method of mass spectrometry comprising a method as claimed in claim 9.

11. A Time of Flight mass analyser comprising:

one or more orthogonal acceleration electrodes;

a drift or time of flight region arranged downstream of said one or more orthogonal acceleration electrodes;

one or more electrodes arranged in said drift or time of flight region; and a device arranged and adapted to apply an oscillating voltage to said one or more electrodes arranged in said drift or time of flight region in order to reduce second or higher order spatial focusing aberrations.

12. A method of analysing ions comprising:

providing one or more orthogonal acceleration electrodes, a drift or time of flight region arranged downstream of said one or more orthogonal acceleration electrodes and one or more electrodes arranged in said drift or time of flight region; and applying an oscillating voltage to said one or more electrodes arranged in said drift or time of flight region in order to reduce second or higher order spatial focusing aberrations.

* * * * *